US007318891B1

(12) United States Patent
Malone

(10) Patent No.: US 7,318,891 B1
(45) **Date of Patent: *Jan. 15, 2008**

(54) NOAH'S PITCH PROCESS

(75) Inventor: Donald P. Malone, Grayson, KY (US)

(73) Assignee: DTX Technologies LLC, Lexington, KY (US)

( * ) Notice: Subject to any disclaimer, the term of this patent is extended or adjusted under 35 U.S.C. 154(b) by 238 days.

This patent is subject to a terminal disclaimer.

(21) Appl. No.: 10/962,023

(22) Filed: Oct. 8, 2004

Related U.S. Application Data

(60) Provisional application No. 60/516,695, filed on Nov. 3, 2003.

(51) Int. Cl.
*C10C 3/06* (2006.01)
*C10C 3/10* (2006.01)

(52) U.S. Cl. ..... 208/41; 208/22; 208/40; 208/44; 208/49; 208/50; 208/67; 208/72; 208/85; 208/131

(58) Field of Classification Search ..... 208/22, 208/40, 41, 44, 49, 50, 67, 72, 85, 131
See application file for complete search history.

(56) References Cited

U.S. PATENT DOCUMENTS 1,527,847 A 2/1925 Duckham et al.
1,672,459 A 6/1928 Jansen
2,005,077 A * 6/1935 Dickson ..... 208/22
2,276,307 A 3/1942 Houdry
2,768,119 A 10/1956 Nash
3,140,248 A 7/1964 Bell et al.
3,928,170 A 12/1975 Takahashi et al.
4,012,457 A 3/1977 Bredeson et al.
4,026,788 A 5/1977 McHenry
4,671,864 A 6/1987 Sawran et al.
5,238,672 A 8/1993 Sumner et al.
5,429,739 A 7/1995 Hanks et al.
5,614,164 A 3/1997 Sumner et al.
5,619,806 A 4/1997 Warren
6,110,239 A 8/2000 Malone et al.

* cited by examiner

*Primary Examiner*—Glenn Caldaeola
*Assistant Examiner*—Prem C. Singh
(74) *Attorney, Agent, or Firm*—Richard D. Stone

(57) ABSTRACT

A process for producing pitch from pitch precursors, such as wood tar, coal tar or petroleum fractions is disclosed. Direct contact heat exchange of the pitch precursor with molten metal, preferably maintained as a metal continuous bath, heats the pitch precursor to a temperature sufficient to induce thermal polymerization reactions and produce a pitch product.

15 Claims, 2 Drawing Sheets

NOAH'S PITCH PROCESS

CROSS REFERENCE TO RELATED APPLICATIONS

This application claims the benefit, and is a copy with editorial revision, of my prior provisional application No. 60/516,695, filed Nov. 3, 2003, which is incorporated by reference.

FIELD OF INVENTION

The invention relates to producing pitch by thermal polymerization.

BACKGROUND OF INVENTION

Pitch production, the making of a high softening point material by inducing thermal polymerization of normally liquid streams, is an ancient process.

Use of pitch, for sealing baskets of reeds floating in the river, or for sealing Noah's ark, is reported in the Bible. "Make thee an ark . . . pitch it within and without with pitch." Genesis 8 14.

While some commentators believe Noah used naturally occurring petroleum seeps, others believe that the pitch referred to was wood tar pitch, made by taking the sap of trees and heating in a metal kettle, to drive off volatile components and induce thermal polymerization in the remaining liquid fraction. By such processing, the ancients could produce a pitch material which would have had both significant preservative and waterproofing properties. For purposes of this patent specification, it will be presumed that Noah used pitch derived from wood tar.

With the rise of great sailing ships, made of wood, use of pitch increased. Pitch was made from sap, from charcoal and from the roots of pine trees. Pine tar was used so extensively on ships that sailors were often called "tars", in reference to the constant contamination of their feet with tar due to use on decks and line. From 1720 to 1870, North Carolina was the world's leading producer of naval stores, turpentine, pitch and tar, all made from the state's abundant pine trees.

While wood tar pitch was the primary pitch product for millennia, it gradually was displaced in importance by pitch derived from coal and, eventually, from petroleum. Although these materials (trees, coal and petroleum) may seem very different, they all provided a suitable starting point in a process to make pitch. Some of the similarity, despite very different starting materials, can be inferred from the definitions of wood tar and coal tar, reviewed next.

Wood tar is defined, by the *Encyclopedia Britannica*, online version, as "liquid obtained as one of the products of the carbonization, or destructive distillation, of wood." Although wood tar based pitch was probably the first pitch product, it is also possible to produce pitch from coal. Coal tar is defined by Britannica as a "principal liquid product resulting from the carbonization of coal, i.e., the heating of coal in the absence of air, at temperatures ranging from about 900 to 1,200° C." Coal tar pitch is made from coal tar. In addition to wood and coal based pitch products, liquid petroleum fractions can be converted into tar or petroleum pitch.

All pitch processes are similar. All start with, or produce as an intermediate product, a relatively low molecular weight liquid material. Cooking pine produces pine tar, with further heating producing wood tar pitch. Cooking coal produces coal tar, with further heating, or at least fractionation, producing coal tar pitch. When a heavy, aromatic refinery bottoms stream is heated sufficiently to induce thermal polymerization, petroleum tar and, eventually, petroleum pitch is formed. In some pitch processes, e.g., production of coal tar pitch, the intermediate light liquid phase may not observed or recovered as a separate product. Thus coal can go from coal to coke plus coal tar pitch plus intermediate products. The inherently high temperatures used in coal coking destructively distill the coal, simultaneously freeing normally liquid coal components and inducing their thermal polymerization into coal tar pitch fractions.

Little wood tar pitch is made or used today, except in specialized circumstances like reconstruction of tall ships or where other sources of pitch precursors are not readily available. Coal tar pitch is widely used for roofing, coatings, in anodes and for myriad other applications, but there are concerns about carcinogens, both released to some extent during the manufacturing process and in the finished product. Some states bar sales of some coal tar based products, because of concerns about toxicity. Petroleum pitch is commercially available and can be used for many of the coal tar pitch applications.

Processes making pitch from wood and coal sources typically use controlled combustion to heat a solid containing a pitch precursor. Controlled combustion, or oxygen injection during pitch manufacture, can degrade the quality of the product, in addition to burning some of it. Use of a hot metal surface to complete thermal polymerization, e.g., metal pot on an open fire as in Noah's time or a coil of metal inside a fired heater, protects the liquid pitch precursor from the fire but suffer from other drawbacks. It is hard to control and limit thermal polymerization reactions—once started; polymerization increases the viscosity and melting point of the polymerized material. The thickest parts of the partially polymerized pitch will be near the hottest surface. Hot spots in the pot or in the tubes of the fired heater can over polymerize the liquid feed, leading to a super thick, sticky material which rapidly cokes to form solids. As the pitch gets thicker, it is harder to move it off of a hot metal surface, so coking or fouling of the hot metal surface is likely to occur.

There are additional problems associated with making a binder pitch, with a softening point of 225-250° F., especially when attempts are made to produce this material from a petroleum source rather than coal tar. To make pitch from a petroleum fraction or any other light material, it is necessary to start with something having a relatively low molecular weight and heat it sufficiently to induce thermal polymerization. The high temperatures which induce thermal polymerization also lead to coking, with the coke clogging the plant and contaminating the product. In the early 1960's, a patentee reported that "Because of the stringent requirements, commercial pitch binders have been almost exclusively made from selected coal tar products." U.S. Pat. No. 3,140,248, Jul. 7, 1964. That patentee, a petroleum refiner, reported several old "tricks" used to make high softening point material, which were reported not to work when binder pitch was desired, and a new trick which was alleged to work.

The "old" methods of making binder pitch started with catalytic cracking, to produce an aromatic rich bottoms material, limited thermal cracking of this aromatic rich material to produce "thermal asphalt", followed by "soaking" for 3 to 5 hours in a soaking tank. While this approach produced pitch, the pitch was contaminated with coke and the soaking tank coked up. The improvement of the '248 patent was a continuous process. The aromatic rich feed was still thermally cracked to produce a "thermal asphalt", but the thermal asphalt was then upgraded in a continuous process utilizing "short residence times and high lineal velocities" to make binder pitch. Thermal asphalt was upgraded to pitch in a soaking coil, in a furnace operating at carefully controlled conditions, including a residence time of at least about 4 minutes and no greater than 20 minutes. By using a flowing coil for "soaking" and limiting the soaking time to minutes instead of hours, it was reported possible to make pitch product with satisfactory properties.

The problems associated with making high softening point pitch products, products with a softening point above 250° F., are even more severe. Pitch producers try to compensate for the inherent instability of intermediate pitch products by operating at a vacuum (to reduce the temperatures required to remove volatiles) and/or operating with a wiped film evaporator, which relies on thin films and brute force mechanical wiping to prevent the pitch from staying for a long time in contact with a hot metal wall.

At this point, a detailed review of several pitch processes will be made, to show the state of the pitch manufacturing art in recent decades.

U.S. Pat. No. 2,752,290, assigned to Cabot, disclosed a continuous process for making pitch.

U.S. Pat. No. 2,768,119, filed Dec. 31, 1952, assigned to Phillips Petroleum, taught making petroleum pitch. An aromatic extract was prepared by solvent extraction, then thermally cracked to produce a fuel oil fraction from which pitch was recovered by vacuum distillation. The patentee reported that pitch could be made from petroleum and had many of the properties of coal tar pitch. The vacuum distillation conditions included a "pressure of about 1 mm Hg, a temperature in the range 440° F. to 650° F." Presumably the vacuum distillation step was used to remove sufficient volatile matter to produce a product with the desired softening point (188° F. to 240° F. reported in the patent) without rapidly coking the distillation apparatus.

U.S. Pat. No. 2,992,181, assigned to Sinclair Refining, disclosed making petroleum pitch.

U.S. Pat. No. 3,140,248, filed Mar. 6, 1962, assigned to Socony Mobil, discussed above, taught making binder pitch by thermal cracking at 850 to 1050° F., at pressures of 250-900 psig, to produce "thermal asphalt" having a softening point of 130 to 170° F. The thermal asphalt passed through a continuous soaking zone maintained at 940 to 1020° F., with a liquid residence time of 4 to 20 minutes, preferably 7 to 15 minutes. The soaking zone operated at 30-400 psig, preferably 100-200 psig, to limit formation of excess coke in the pitch binder product.

U.S. Pat. No. 3,692,663, assigned to Osaka Gas, taught heating a tar fraction to 320-470° C. to make gas oil and pitch.

U.S. Pat. No. 3,928,170 taught injecting hot gas into heavy oil to make pitch.

U.S. Pat. No. 3,974 and U.S. Pat. No. 4,026,788, McHenry, taught pitch manufacture with inert gas sparging.

U.S. Pat. No. 3,976,729 and U.S. Pat. No. 4,017,327, Lewis, taught making pitch with agitation during heat treatment.

U.S. Pat. No. 4,039,423, assigned to Gulf Oil, taught heating, flashing and "oxy-activation" to make pitch.

U.S. Pat. No. 4,066,737, assigned to Koppers, describes an oxidative pitch process, which was part of a method of making carbon fibers.

U.S. Pat. No. 4,242,196 assigned, inter alia to Sumitomo Metal, taught heating a resid to 450-520° C. in a tubular heater for 0.5-15 minutes, then passing an inert gas at 400-2000° C. for direct contact heating for ½-10 hours, to make pitch.

U.S. Pat. No. 4,243,513, assigned to Witco, taught treating clarified slurry oil at 390-410° C. for 2+ hours, under reflux, to make pitch.

U.S. Pat. No. 4,340,464, assigned to Sinclair Refining, Method for Thermal Cracking of Heavy Petroleum, taught how to make pitch.

U.S. Pat. No. 4,431,512, assigned to Exxon, taught heat soaking steam cracker tar middle distillate at 420-440° C. for 2-6 hours, then vacuum stripping. Their U.S. Pat. No. 4,427,530 disclosed a similar process, using FCC bottoms as feed.

U.S. Pat. No. 4,522,701, assigned to DuPont, taught making pitch by heat soaking FCC residue fractions.

U.S. Pat. No. 4,673,486 taught treating a solvent deasphalted fraction with a carrier gas and thermal cracking at 400-600° C. to produce gas oil and pitch products.

U.S. Pat. No. 4,961,837, assigned to Intevep, Caracas, VE, taught making petroleum pitch for use as pitch binder.

U.S. Pat. No. 4,999,099 taught use of an oxidative purge gas to make pitch. An FCC heavy resid fraction was heat soaked at 3850° C., then subjected to an O2+N2 sparge.

U.S. Pat. No. 5,540,832, assigned to Conoco Inc., taught making mesophase pitch from refinery decant oil residue by heat soaking at 386° C. for 28 hours with N2 agitation.

Ashland Petroleum has a series of patents on high softening point pitches, primarily for manufacture of carbon fiber. Their U.S. Pat. No. 4,671,864 taught vacuum flashing, or use of a wiped film evaporator, to reduce residence time of pitch at high temperature and make pitch having a softening point of about 250° C. U.S. Pat. No. 5,238,672 taught heating isotropic pitch with inert gas, at high temperature, to make mesophase pitch. U.S. Pat. No. 5,316,654 taught use of a wiped film evaporator (WFE) to make high softening point pitch. U.S. Pat. No. 5,429,739 taught use of reduced pressure and partial oxidation, converting a conventional 250° F. softening point pitch to a higher softening pitch in a WFE. The conventional output from a WFE was low, partial oxidation sped up the process. U.S. Pat. No. 5,614,164 taught use of a WFE to make mesophase pitch. The process started with a pitch with a softening point of 93-233° C., processed this in a WFE for 115-300 seconds to produce "enriched pitch" with a 5% maximum mesophase content, then stripped with an inert gas for up to 18 hours to produce the desired pitch product, with a softening point of 177-399° C.

The Eureka® Process, jointly developed by Kureha Chemical Industry Co. Ltd and Chiyoda, has been used for over 20 years to make pitch products. The process reduces the cracked oil partial pressure by injecting steam into the pitch forming reactor. Steam injection also helps keep the molten pitch as a homogeneous liquid.

Although not related to pitch production, mention will be made at this point of use of molten metal baths, for metal plating, to make float glass and to dry paper pulp, in U.S. Pat. No. 5,619,806, Drying of Fiber Webs, Warren. The patentee used an alloy composition of bismuth and zinc.

All of the patents discussed above, and hereafter, are expressly incorporated by reference, in their entirety.

This review of industrial pitch processes shows work making pitch has continued for most of the last century. In addition to this historical patent work, primarily by major refiners or by pitch manufacturers, some work has been done recently at universities on new ways of making pitch, with most focus being on higher softening point pitches.

I reviewed these multiple routes to pitch products, especially to high softening point pitch products, and felt there was a need for a better way to make pitch. I did not want to have to burn some product to make it (oxygen or air injection as a heat source). I did not like the use of hot metal surfaces to heat viscous pitch products or precursors, these hot surfaces were cursed with a "Midas touch", which produced coke, rather than gold. I especially wanted to avoid the high capital and operating cost of, and limited throughputs associated with, use of high vacuum and wiped film evaporator technology.

In reviewing the problems associated with this process, which has been around for millennia, I discovered a better way to heat the pitch precursors and/or the intermediate softening point pitch products, which completely avoided the problems associated with use of hot, solid metal surfaces to heat pitch and pitch precursors.

I realized that by using a technique and technology used for decades to make plate glass (forming glass on a bed of molten metal), I could overcome the heating barrier imposed by solid metal heating surfaces. I used a molten metal bath to heat the pitch precursors, pitch intermediates and/or final product.

The molten metal bath was wonderfully efficient at heating the feed to a sufficiently high temperature to induce thermal polymerization. Molten metal was relatively free of hot or cold spots, because of its high thermal conductivity. More important, neither the pitch precursors nor the pitch product would stick to the molten metal.

Molten metal also permits a flexible design approach, permitting injection of the metal into the oil or vice versa, though not necessarily with equivalent results. When pitch, or a pitch precursor, is injected into a molten metal bath, it is easy to increase or decrease process severity by changing the depth of molten metal in the bath, the temperature of the metal, the pressure in the molten metal bath or the presence of a stripping gas to create a "pseudo vacuum", or some combination of these. For the first time, pitch producers have many more degrees of freedom to pursue the best pitch product, in a process which is wonderfully tolerant of mistakes. While mistakes may be made, the coke so generated will not stick to the molten metal, so the pitch plant can generally producing pitch even if some solids will be present. It is better to have a plant that continues to work, when making some off spec product, than a plant which shuts down with coke deposits.

BRIEF SUMMARY OF THE INVENTION

Accordingly, the present invention provides a process for thermally polymerizing a thermally polymerizable chargestock to produce a liquid pitch product having a desired softening point comprising heating said chargestock by direct contact heat exchange with an immiscible molten fluid for a time sufficient to heat said chargestock to produce heated chargestock having a temperature sufficient to induce thermal polymerization and thermally polymerizing at least a portion of said heated chargestock to produce a liquid product comprising pitch having a desired softening point.

In another embodiment, the present invention provides a process for thermally polymerizing a liquid feed selected from the group of wood tar, coal tar, and petroleum liquids and mixtures thereof to produce a pitch product having a desired softening point comprising heating said liquid feed by direct contact heat exchange with molten metal in a heating zone for a time sufficient to produce heated feed having a temperature sufficient to induce thermal polymerization, thermally polymerizing said heated feed for a time sufficient to produce a mixture of pitch product and lighter products produced by said thermal polymerization and fractionating, or flashing, said mixture to recover a liquid pitch product having a desired softening point.

The invention will be more fully understood from the following description of the preferred embodiment taken in conjunction with the figures.

DETAILED DESCRIPTION OF PREFERRED EMBODIMENTS

Figure 1:
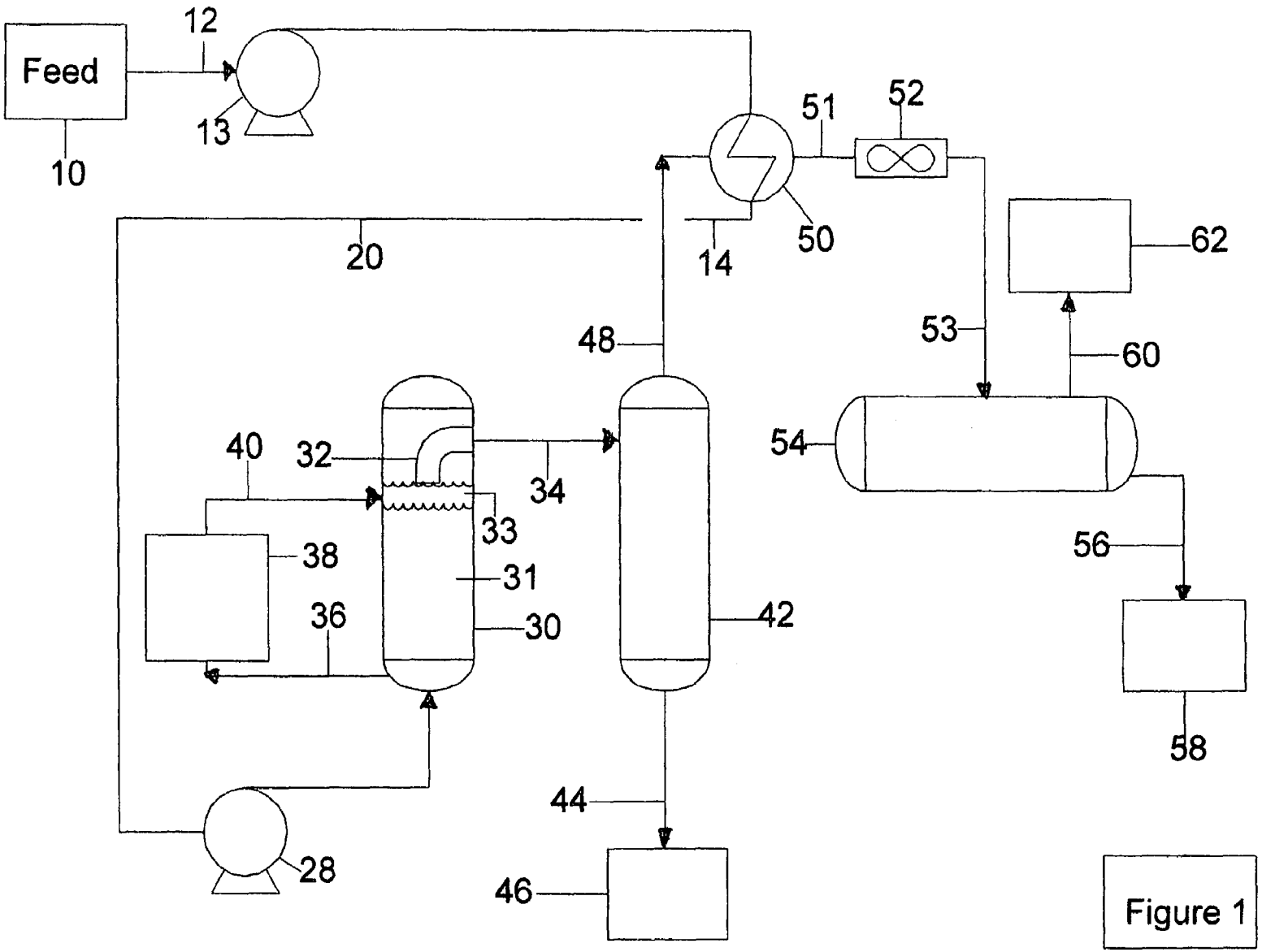
FIG. 1 is a simplified schematic drawing of a preferred embodiment wherein a feedstock is converted into pitch in a single molten metal bath, with injection of feedstock into a lower portion of the molten metal bath.

In FIG. 1, a feedstock, e.g., FCC slurry oil, flows from a feed storage system, 10, through line 12 to the feed pump, 13, into heat exchanger 50 to produce a preheated pitch feed. Preheated feed is charged via lines 14 and 20 through optional pump 28 into direct thermal exchange heating zone 30. Sometimes the term DTX will be referred to as this zone or this approach, using molten metal for Direct Thermal eXchange (DTX) of crude pitch. Any heat transfer fluid that is immiscible with, and preferably much denser than, pitch precursor feed may be used, but molten metal is ideal. In the embodiment shown, molten metal circulates from the bottom to the top of contactor vessel 30. DTX fluid is removed from the DTX heating zone 30 by line 36, heated in heater 38 to produce heated molten metal which is discharged via line 40 to heating zone 30. Heater 38 may use electrical resistance elements, a fired heater, superheated steam or the like as a heat source. Although a separate molten metal heater 38 is shown, it is also possible to dispense with the separate molten metal heater and use electric resistance heaters or other heating jacket means, not shown, disposed around the heating zone 30 to satisfy the heat demand of the process. Heat transfer fluid flow through heater 38 may be controlled by natural convection, as shown, or a pump, not shown, may be used. The total liquid level in the contactor, 33, is maintained by a vertical outlet pipe, 32, through which all gas, vapor and liquid leave the vessel and flow through line 34, to the separator vessel, 42. The inventory of heat transfer fluid sets its level in the contactor or heater 30. When the level of the heat transfer fluid, 31, is relatively high as shown in FIG. 1, the liquid feed is the predominately dispersed phase and the molten metal heat transfer fluid is the predominately continuous phase.

Molten metal phase 31 is continuous and fills the lower portion of vessel 30. Pre-heated pitch precursor feed from the heat exchanger is charged to or near the bottom of the molten metal phase. A distributor or weir, not shown, may be used if desired. The feed is rapidly heated by direct contact with molten metal. The feed may be heated sufficiently, and may have a residence time in the molten metal bath to permit the desired degree of thermal polymerization to take place, or the liquid feed may simply be heated to a temperature high enough to permit thermal polymerization, with the bulk of the polymerization occurring downstream of the molten metal heater, in means not show. As shown in FIG. 1, the heated liquid feed is a dispersed phase, which may be entirely liquid or a mixture of vapor and liquid, as it passes up through the continuous molten metal phase. The heated liquid, and any vapor formed, rises from the molten metal bath and forms a heated liquid feed continuous phase which "floats" on the molten metal. A modest inventory of heated liquid is maintained above the molten metal bath, with the lower limit set by the top layer of the molten metal bath and the upper limit set by vapor/liquid withdrawal means 32 disposed a distance above the molten metal bath. Heated feed liquid will accumulate in region 33 until the level is sufficiently high so that the net input of liquid is removed or entrained with gas flow through outlet 32. Heated liquid and vapor components are then transferred via line 34 to vessel 42 wherein pitch vapor is allowed to separate from pitch liquid. Pitch liquid is withdrawn from vessel 42 via line 44 and collected in product tank 46. The pitch liquid may have the desired softening point, or further fractionation or flashing in means not shown may be required to remove sufficient volatile matter to produce a product having the desired softening point. The vapors produced by thermal polymerization, and some thermal cracking which usually accompanies thermal polymerization, are removed via line 48 and used as a heat exchange fluid to preheat incoming feed in heat exchanger 50. The cooled vapors are withdrawn from exchanger 50 and charged via line 51 to fin fan cooler 52 or other heat recovery or cooling means, not shown, to produce a cooled and partially condensed overhead stream which is charged via line 53 to overhead receiver 54. An overhead receiver vapor phase is removed via line 60 and charged to product storage means 62, or burned as fuel by means not shown. An overhead receiver liquid phase product is removed via line 56 and collected in product storage tank 58.

Figure 2:
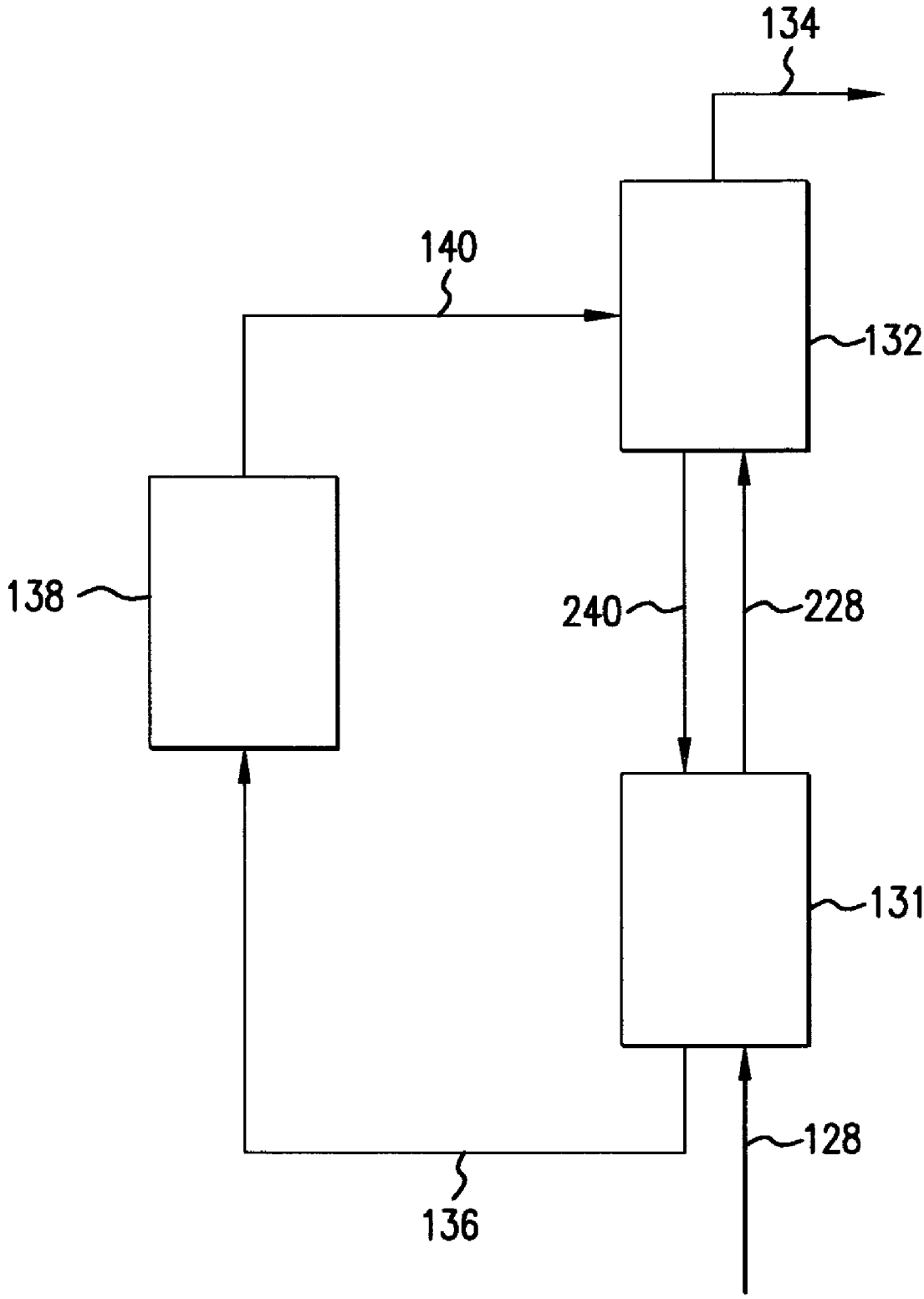
FIG. 2 is a multi-zone molten metal pitch process.

FIG. 2 is a simplified, block diagram of the process flow involved when two stages of molten metal heating of a pitch precursor feed occur. The process flow is somewhat similar to that which occurs in a fractionator with two trays, at least in terms of vapor and liquid flow, but very different in terms of temperature. Molten metal flows down the "distillation column", while pitch precursor feed in line 128 is added to the bottom of the column. Liquid bubbles up via line 228 from the first "distillation stage" 131 to enter the molten metal bath in the second "distillation stage" 132 for further heating and vaporization. The vapor phase from the first distillation stage may be removed from the process or passed up with the partially polymerized, or at least partially heated to polymerization temperature, feed into the second stage. Temperatures increase up the column, with the temperature highest in the top or second stage and lowest in the first stage. This temperature profile is achieved because the metal starts cooling as soon as it enters the "tower" via line 140 and starts work heating, cracking and polymerizing the pitch precursor feed. The metal enters the top of the "fractionator" at its peak temperature and is cooled by heating and vaporizing the liquid and/or vapor, removed via line 134, in the top distillation stage. This somewhat cooled molten metal then flows down via line 240 to the lower distillation stage, where further cooling of molten metal occurs because it is heating the incoming feed. The molten metal is withdrawn via line 136 from or below the lower stage and pumped or, preferably, sent through a thermosiphon reboiler 138, as in FIG. 1.

Operating Conditions

Although the process of making pitch can seem simple—boil some pine tar down until it gets hot and sticky—it is fairly complex, involving thermal cracking, thermally induced polymerization and, usually, vaporization of distillable components.

The new pitch making process described herein can start with any of the starting materials used in the prior art to make pitch, e.g., pine tree sap, and produce a high softening point pitch, but it is neither necessary nor desirable to start so high up in the pitch product tree as the sap.

An essential part of any pitch process is thermal cracking and thermal polymerization. As reported in U.S. Pat. No. 3,140,248, it is possible to segregate, to some extent, these two reactions and conduct "thermal cracking" followed by thermal polymerization (the "soaking" reaction in '248). This segregation and nomenclature is hard to follow in that thermal cracking takes a heavy feedstock and cracks it into lighter stocks, while in '248 the reactions occurring are complex and competing. Ex. 1 shows a "syntower" bottoms stream is "thermally cracked" at 940° F., 400 psig, with a 3:1 recycle to fresh oil recycle, with recycle oil thermally cracked at 1040° F. and 400 psig, to produce a thermal crackate with over 60 wt % "thermal asphalt", with a softening point of 160° F. The term "thermal cracking" does not completely describe the thermal reactions occurring as thermal cracking, by definition, reduces molecular weight. In '248, the "thermal cracking" step converted most of the feed, into asphalt, which is non-distillable. A lot of thermal cracking went on in the "thermal cracker", as evidenced by the conversion of the feed into 11.w wt % dry gas, 3.6 wt % butane, etc, but most of the feed was converted into something heavier, the thermal is asphalt which accounted for 61.0 wt % of the product.

The thermal asphalt was then passed through a "continuous soaking zone" to complete the conversion of thermal asphalt into pitch.

The details of '248 were reviewed to show that it is difficult to describe all the reactions going on during pitch manufacture, even when the pitch production process is broken down into multiple steps. The "thermal cracking" step was primarily a thermal polymerization step, based on wt % product, while the "soaking step" produced modest amounts of gas and gas oil, which are indicative of thermal cracking.

Rather than try to fit complex and competing reactions into labels which are not adequate to describe what is going on, this specification and claims will at times refer to thermally induced reactions, rather than "thermal cracking" or "thermally induced polymerization" and recite temperatures, pressures and residence times, or a reaction severity sufficient to convert a given feed into a product with the desired properties.

It will frequently be beneficial to conduct the thermal reactions required to make pitch in multiple stages, either directly in the pitch plant or indirectly, by selecting feedstocks which have already been subject to thermal treatment. As was done in '248, and many other pitch patents, it will be beneficial to have one or more stages of initial thermal treatment of a suitable feedstock, to increase its aromaticity and achieve a significant amount of thermal polymerization. There is little or no risk of coking when a low softening point pitch, or "thermal asphalt" as discussed in '248, is the desired intermediate product. The technology to make such materials is well known and widely available, so the pitch producer may choose to conduct at the least the initial steps of the journey toward pitch in a "thermal cracker" or by buying residue from thermal crackers. If a pitch producer chooses to start with one of the conventional starting materials, e.g., FCC main column bottoms, it may be convenient to use conventional "thermal cracking", as in '248 to achieve a significant amount of thermal polymerization, which could be more or less than that achieved in '248.

Where the present invention is essential is in the difficult stages of the pitch production process, analogous to the "soaking coil" treatment reported in '248. Rather than use a drum soaker (prior art reported in '248), or a continuous coil soaker (the invention in '248), a DTX heater is used to produce the high softening point pitch.

The DTX heater, when run with a molten metal continuous phase, by its very nature is a continuous process. Any pitch precursor feedstock injected will rapidly be heated, and may or may not be vaporized depending on pressure and temperature, and will bubble up through the molten metal.

It is possible to use the DTX heater solely to heat the pitch precursor and to maintain pressures sufficiently high to keep the feed essentially in the liquid phase, with the heated and wholly or partially reacted feed subjected to product fractionation and recovery. A metal phase continuous DTX reactor is superb at heating any feed, and quickly bringing it within a few degrees, typically 5° C. or less, of the metal temperature. Temperature is only part of the complex equation that defines thermal reactions, time is equally important. Because the DTX reactor is so efficient at moving the lighter liquid out of the molten metal, it may be preferred to use the DTX reactor only for heating and initiating thermal reactions, with the reactions completed downstream of the DTX heater. Preferably the reactions occur in a transfer line connecting the DTX reactor to the downstream product recovery facilities. A soaking drum can be used, but for the same reasons discussed in '248, a coil or other continuous process is preferred for the heated pitch precursors. Today, as in 1962, the use of a coil is good at minimizing "dead spots" where coke can form. There is a significant additional advantage to the DTX heater, as the hottest spot in the plant is the molten metal, to which neither pitch nor pitch precursors will stick. The downstream soaking coil, or whatever device is used to permit additional thermally induced reactions to occur, is cooler than the DTX reactor. There is no time when solid metal surfaces have to be hotter than the heated pitch, so there is less tendency for thermal reactions to occur on metal surfaces.

In broad terms, any conditions of time, temperature and pressure which have been used in the prior art to produce pitch from pitch precursors may be used herein. The art is replete with mention of specific feedstocks and conditions which have satisfactorily produced pitch. The DTX heater is an elegant solution to the problem of preventing fouling during heating, but it is still just a heater, one which can be used to replicate the functions, and temperatures and pressures, of any prior art heater used in a pitch process.

Depending on the stage of the process in which the DTX heater is used, i.e., whether for an initial treatment—the "thermal cracking" of '248 or to achieve the final push to a high softening point material—the "soaking zone" of '248, it may be desirable to run the process under considerable pressure, at atmospheric pressure, or under a vacuum.

If the DTX heater is used on, e.g., a cracker bottoms, it probably will be preferred to operate the process under 1-50 atmospheres, absolute, pressure and to limit temperatures so that most, or all, of the reaction will be conducted under liquid phase. The size and complexity of a DTX reactor will be reduced compared to one that has to deal with more than 2 phases and large volumes of vapor.

For many applications, especially small capacity pitch plants, or a pitch plants added to existing capacity to make a specialty product, it will be preferred to operate the DTX reactor at atmospheric pressure, for safety and to reduce capital costs. The DTX thermal reactor can easily achieve high temperature operation without coking. For many applications, the temperatures achievable in the DTX reactor at atmospheric pressure will be compatible with the time and temperature needed to make a desired product, so the pitch refiner can choose to operate at, or near, atmospheric pressure, much as petroleum refiners operate their crude still at atmospheric pressure.

For applications where product properties are crucial and/or require low temperature operation, it may be desirable to operate the DTX thermal reactor, or at least the transfer line immediately downstream of it, under vacuum. The pitch fractionation can occur using pressures similar to those used for vacuum distillation of crude oil, or very high vacuums can be pulled on either the pitch product or on the DTX thermal reactor.

As reported in '248, it may be preferred to operate in stages. Thus the DTX thermal reactor can operate at 60-120 psig, then the reactor effluent, containing pitch and the by-products of both thermal cracking and thermally induced polymerization, can be flashed at or near atmospheric pressure to recover gasoline and lighter components, with the residue from the atmospheric flash finally subjected to vacuum flashing or vacuum distillation at a temperature and pressure required to meet product specifications. To aid in stripping of volatile material from the crude pitch product, steam or inert stripping gas may be injected into any part of the process desired, e.g., into the atmospheric flash drum, or into the vacuum distillation column.

Any metal can be used as part or all of the molten metal bath, so long as it is in a liquid phase at the desired operating temperature. Metals which can be used include lead, tin, antimony, mercury, cadmium, sodium, potassium, bismuth, indium, zinc, gallium. Preferably the metal used melts below 600° F. (315.5° C.) or forms an alloy that does. Not all metals will give equal results and some present significant safety concerns, e.g., lead or mercury, but they can be included as part of the molten metal bath, if desired.

Any feed containing a normally liquid hydrocarbon can be heated using the process of the present invention. The normally liquid hydrocarbons include C5 and heavier hydrocarbons, e.g., naphtha boiling range up through residual fractions. Heavy feeds are contemplated for use herein, including those which are so heavy that they are not liquid at room temperature, e.g., grease, wax, petrolatum or indeed any hydrocarbon having a high melting point. These materials will, upon heating, form liquids and may be used as feed. Treatment of solids is outside the scope of the present invention, i.e., treatment of coal or dirt contaminated with oil is outside the scope of the present invention. What is essential for the practice of the present invention is direct contact heat exchange of a liquid by a liquid. The liquid must contain hydrocarbons and can even be a pure hydrocarbon. The liquid feed usually will be contaminated with undesired lighter or heavier components which can be removed by heating, either to vaporize a desired feed component from a residue fraction or to remove an undesired lighter contaminant from a desired residue product fraction.

The invention contemplates the use of a range of molten metals for the high-intensity drying and/or heating process. These include low-melting point metal alloys. When simple drying or only a modest amount of thermal processing is desired, the candidate molten fluids may have melting points typically ranging from 60-230° C.

It is essential that the heating fluid be immiscible with the FEED and substantially denser.

It is preferred that the interfacial surface tension between the molten metal heat transfer media, or other fluid which is immiscible with the feed being treated, and the liquid feed be sufficiently high to avoid sticking of the molten fluid to the wet surface. The thermal conductivity of the molten fluid should also be sufficiently high to ensure that the molten fluid remains in a liquid state, at least during the process, so that fluid does not solidify to form a solid film or freeze cone at the point of contact with the feed.

When the thermal conductivity of the fluid is sufficiently high, the fluid conducts heat from the body of the molten bath to the interface contact region between drops or streams of feed and molten heating medium, or drops or streams of molten heating medium when the feed is the continuous phase. The use of molten metal alloys is preferred due to their high interfacial surface tension with decomposition products that may form from, and trash that may be found in, the feed. Metals are also preferred over other immiscible fluids due to their high thermal conductivity. An additional benefit is the high density of molten metal relative to feed, which promotes rapid transit of one fluid through the other and plenty of motive force should baffles or column packing be used.

Table 1 summarizes some estimated properties for several recommended molten metal eutectic alloy materials, when only moderate severity heating is required. This alloy information is taken from information reported in U.S. Pat. No. 5,619,806, which is incorporated by reference.

TABLE 1

Properties of Candidate Molten Materials

| | Melting Temp ° C. | Therm. Cond. (Btu/ft$^2$/h/° F.) | Spec. Heat (Btu/lb/° F.) | Surface Tension (dyne/cm) |
|---|---|---|---|---|
| In/Sn(52/48) | 118 | 19.6 | 0.060 | 580 |
| Bi/Pb(55/45) | 124 | 7.7 | 0.035 | 391 |
| Bi/Sn(58/42) | 138 | 11.6 | 0.046 | 447 |
| Sn/Pb(63/37) | 183 | 14.5 | 0.051 | 528 |
| Sn/Zn(92/8) | 199 | 20.0 | 0.061 | 594 |
| "Tin Foil" Sn/Cu(99/1) | 227 | 19.0 | 0.061 | 587 |

The metallic material of the bath may consist of an alloy selected from the group that includes:

i) Ga/In ii) Bi/In iii) In/Sn iv) Bi/Pb v) Bi/Sn vi) Sn/Pb vii) Sn/Zn viii) Sn/Cu.

A spectrum of molten metal temperatures can be used, from high to low. Based on the float bath process for making plate glass, tin has ideal properties when a relatively high temperature bath is desired. Tin has a melting point of 232° C. and a boiling point of 2623° C. This means that a range of temperatures can be achieved in the molten metal bath, ranging from temperatures near the boiling point of water (when a low melting alloy like Wood's metal is used, to temperatures above 500° C. For ease of startup, i.e., a relatively low melting point, a tin-bismuth alloy is preferred.

EXPERIMENTS

The experiments were conducted to test the concept of use of a molten metal bath to heat a hydrocarbon liquid feed. Temperatures used were very low, sufficient to dehydrate and distill vaporizable hydrocarbons, but in general much lower temperatures were used in this experiment than would be used in a commercial plant. No pitch product was produced in this example.

The thermal reactor was a length of 4" schedule 40 stainless steel pipe. The metal alloy used was a tin-bismuth eutectic that is 42% tin and 58% Bismuth. The depth of molten metal was about 20", with about 12" of freeboard or vapor space above the molten metal. The stainless steel pipe was heated by a cylindrical heater, an electric jacket with a thermostat. The initial series of tests on feed was conducted at about 600° F. molten metal bed temperature. The feed was fed into the bottom of the molten metal bath via a ¼" nipple to which a length of ⅛" SS tubing was affixed. The tubing did not extend into the molten metal bath. The process ran under vacuum, estimated at about 0.5-1 psia, but the pressure gage used was not very accurate at these low pressures.

Based on the work done to date, the preferred metal composition is the tin-bismuth eutectic that is 42% tin and 58% Bismuth.

When making pitch product, the temperature and pressure will be around 600 to 620° F. and 1 to 1.5 psia. There are actually an infinite number of temperature pressure combinations that will work.

While this test was conducted at relatively low pressure, refiners may wish to operate under a harder vacuum or at atmospheric or super-atmospheric pressure, to minimize vapor volumes and facilitate processing of streams with large amounts of water and/or volatile components. Higher pressures permit a more compact facility to be built.

The experiments used a single molten metal bath, but the invention is not limited to this embodiment. Multiple molten metal baths may be used, much as product fractionators use multiple distillation trays.

It is essential that the heating fluid be immiscible with the pitch and the pitch precursors.

DISCUSSION

It is important to use a metal, usually a metal alloy, with a "heat range" within that required for the desired process objectives. When simple dehydration is all that is required, and this will usually be a first or preliminary treatment rather than the entire process, molten metal which is molten in the 80° C.+temperature range is suitable. When distillation of distillable components is desired, the metal must remain molten at temperatures above 100° C. to say 600° C. When carbonization or "coking" of a residue fraction from either an earlier stage of molten metal processing or when a heavy residual oil fraction from a refinery is to be processed, even higher temperatures may be required, typically 200° C. to 700° C.

The upper limit on temperature/choice of the metal alloy is determined by volatility and process constraints. The preferred molten metals will have a low vapor pressure at the temperatures used, so that loss of molten metal due to "dusting" or for any other reason is less than 1% a day. The metals chosen should not be corrosive under process conditions and preferably are non-toxic, for safety.

For clarity, it is emphasized that there is nothing novel, per se, about a molten metal bath—such baths are well known and widely used in metal casting, manufacture of plate glass, metal coating operations and the like.

There can also be total overlap in operating conditions in the pitch forming thermal reactor as compared to prior art pitch processes. In terms of inducing thermal reactions to make pitch, the DTX thermal reactor is simply a heater and it can be substituted for any heater used in any prior art pitch process, the difference being that the DTX heater will never coke up. When the DTX thermal reactor is simply used to avoid furnace fouling, the conditions used in prior art process can be used herein and the pitch products will be very similar, though products of the DTX pitch process will usually have less coke contaminant.

The DTX pitch process also permits the pitch forming process to operate in regions which were not available in the past. The unique heating method allows efficient heating of pitch precursors to very high temperatures, for very short periods.

The DTX pitch process can operate in conjunction with conventional pitch fractionation facilities. Thus the output of the DTX thermal reactor could be charged into a conventional pitch fractionator or even into a WFE.

The DTX thermal reactor can be run to vaporize volatile components from the pitch and directly produce high softening point pitch, but this is not essential for the practice of the present invention. The DTX pitch process can also be run under sufficient pressure to maintain liquid phase conditions, so that no fractionation or flashing occurs during DTX thermal processing.

If one wished to label a DTX heater arbitrarily as a "reactor" or a "fractionator", this could be done if a majority, or some arbitrary higher percentage, of the reactions/changes going on in or immediately downstream of the DTX heater are, or will be immediately downstream thereof, chemical or physical.

For a DTX heater operating under sufficient pressure to maintain 100% liquid phase operation, there will never be any phase separation in the reactor, but significant thermal or physical reactions could, or will immediately downstream, take place. A pitch precursor charge stock of, i.e., a highly aromatic, high boiling charge stock, could be thermally polymerized at high pressure, say 400 to 1000 psig, and little or no vaporization could occur, despite significant thermal polymerization. There will be production of "light ends", both due to thermal cracking and to thermal polymerization, but there need be little vaporization. The charge stock could be rapidly heated in the DTX heater and discharged into a soaking tank or preferably into a coil, all while maintained at a temperature high enough to induce thermal polymerization. In this embodiment, little reaction of any kind occurs as the coke precursor passes through the molten metal bath other than heating. The pressure is too high to permit vaporization and the time is too short to permit much thermal processing to occur. Thermal processing can occur just downstream. Such a process, where thermally induced chemical reactions convert a majority of the pitch precursor feed into something else, could be called a thermal reactor.

A DTX heater operating under conditions such that the primary physical change occurring in the charge stock is, or will be immediately downstream of the DTX heater, vaporization, could be called a heater or perhaps a fractionator rather than reactor. There is only a minor amount of thermally induced reaction occurring, with most of the change being physical (vaporization) rather than chemical (cracking or polymerization).

Because of the robust heating available with DTX heating, some pitch producers will be inclined to press their DTX heaters into multiple service, simultaneously heating, cracking, polymerizing and vaporizing the pitch-precursor chargestock into a pitch product with the desired properties. Such multitasking is an excellent use of the DTX heater, but chemical engineers will recognize that many different unit operations are being performed.

I claim:

1. A process for thermally polymerizing a thermally polymerizable chargestock to produce a liquid pitch product having a softening point of 200 to 600° F. comprising:

a. heating said chargestock by direct contact heat exchange with an immiscible molten fluid for a time sufficient to heat said chargestock to produce heated chargestock having a temperature sufficient to induce thermal polymerization and b. thermally polymerizing at least a portion of said heated chargestock to produce a liquid product comprising pitch having a desired softening point.

2. The process of claim 1 wherein said chargestock is selected from the group of wood tar, coal tar and normally liquid petroleum.

3. The process of claim 1 wherein said pitch has a softening point within the range of 200 to 250° F.

4. The process of claim 1 wherein said pitch has a softening point above 250° F.

5. The process of claim 1 wherein said heating occurs in a single stage.

6. The process of claim 1 wherein said heating occurs by direct contact heating, in multiple stages, with said molten fluid.

7. The process of claim 1 wherein said heating occurs in a molten metal continuous bath into which, or up through which, said chargestock is charged.

8. The process of claim 1 wherein said heating occurs in a liquid chargestock continuous bath into which, or down through which molten metal in injected or dispersed.

9. The process of claim 1 wherein said heating occurs at a pressure sufficient to maintain liquid phase during heating, and thermal polymerization and vaporization of light ends produced during thermal polymerization occur downstream of said heating step.

10. The process of claim 1 wherein said molten fluid is molten metal with a temperature within the range of 100 to 600° C. and a pressure from 0.01 to 1 atmospheres.

11. A process for thermally polymerizing a liquid feed selected from the group of wood tar, coal tar, and petroleum liquids and mixtures thereof to produce a pitch product having a softening point of 200 to 600° F. comprising:

a. heating said liquid feed by direct contact heat exchange with molten metal in a heating zone for a time sufficient to produce heated feed having a temperature sufficient to induce thermal polymerization, b. thermally polymerizing said heated feed for a time sufficient to produce a mixture of pitch product and lighter products produced by said thermal polymerization, c. fractionating or flashing said mixture to recover a liquid pitch product having a desired softening point.

12. The process of claim 11 wherein said molten metal is maintained as a continuous phase in said heating zone.

13. The process of claim 11 said liquid feed is maintained as a continuous phase within said heating zone.

14. The process of claim 1 wherein said direct contact heat exchange occurs at 0.5 to 1.5 psia.

15. The process of claim 11 wherein said direct contact heat exchange occurs at 0.5 to 1.5 psia.

* * * * *